US012349781B2

(12) United States Patent
Cai

(10) Patent No.: US 12,349,781 B2
(45) Date of Patent: Jul. 8, 2025

(54) TOY HAIRPIN WITH REASONABLE STRUCTURE AND TOY HAIRPIN WEARING DEVICE

(71) Applicant: Liangxiong Cai, Shantou (CN)

(72) Inventor: Liangxiong Cai, Shantou (CN)

( * ) Notice: Subject to any disclaimer, the term of this patent is extended or adjusted under 35 U.S.C. 154(b) by 462 days.

(21) Appl. No.: 18/074,588

(22) Filed: Dec. 5, 2022

(65) Prior Publication Data

US 2024/0058719 A1 Feb. 22, 2024

(30) Foreign Application Priority Data

Aug. 16, 2022 (CN) ..... 202222155042.5

(51) Int. Cl.
*A45D 8/06* (2006.01)
*A63H 33/30* (2006.01)

(52) U.S. Cl.
CPC ..... *A45D 8/06* (2013.01); *A63H 33/30* (2013.01)

(58) Field of Classification Search
CPC ... A45D 8/00; A45D 8/06; A45D 8/16; A45D 8/18; A45D 8/185; A45D 8/20; A45D 8/22; A45D 8/24; A45D 8/26; A45D 8/28; A45D 8/34; A63H 33/30
See application file for complete search history.

(56) References Cited

FOREIGN PATENT DOCUMENTS

CN 204932857 U 1/2016

*Primary Examiner* — Rachel R Steitz
*Assistant Examiner* — Karim Asqiriba
(74) *Attorney, Agent, or Firm* — JEEN IP LAW, LLC

(57) ABSTRACT

A toy hairpin with a reasonable structure comprises a decoration unit, and a clamping unit disposed at the bottom of the decoration unit and comprising a passive clamping part and an active clamping part. A positioning groove is formed between outer surfaces of the decoration unit and the clamping unit. A toy hairpin wearing device for the toy hairpin comprises a positioning plate and a wearing plate. Left ends of the wearing plate and the positioning plate are hinged together. A toy hairpin body clamping member is disposed at a right end of the positioning plate. A base plate positioning seat is disposed at a right end of an inner side, facing the positioning plate, of the wearing plate. The toy hairpin is more convenient and faster to wear and remove, and parts can be changed easily when damaged or lost.

8 Claims, 4 Drawing Sheets

TOY HAIRPIN WITH REASONABLE STRUCTURE AND TOY HAIRPIN WEARING DEVICE

CROSS-REFERENCE TO RELATED APPLICATIONS

This application claims the benefit and priority of Chinese patent application No. 202222155042.5, filed on Aug. 16, 2022, disclosure of which is hereby incorporated by reference in its entirety.

TECHNICAL FIELD

The invention relates to a toy hairpin and a toy hairpin wearing device, and more particularly, relates to a toy hairpin which is more reasonable in structure, more convenient and faster to wear and remove, easier to make and lower in cost, and a toy hairpin wearing device.

BACKGROUND

Hairpins, as common articles for women, are used almost by every woman. The hairpins are of different types and have become indispensable ornaments of modern woman.

Toy hairpins often have a structure similar to that of hairpins commonly used in daily life, and are played and worn by kids. For example, Chinese Patent Publication No. CN204932857U, entitled "Handmade Colored Button Toy", discloses a toy hairpin, which allows users to cling multiple buttons, which are fixed and stacked together through an elastic band 2, to a hairpin. This toy hairpin has a U-structure which is similar to that of hairpins commonly used in daily life and is a common hairpin structure.

However, such a toy hairpin is too simple in structure, thus having a few differences from common hairpins, being not interesting enough, poor in playability, and unable to arouse the interest of kids.

In view of this, the structure of existing toy hairpins is improved. For example, Chinese Patent Publication No. CN214677955U, entitled "Toy Hairpin and Toy Hairpin Wearing Device", discloses a toy hairpin comprising a decoration unit and a clamping unit, wherein the clamping unit is disposed at the bottom of the decoration unit, a positioning groove to be clamped is formed between an outer surface of the decoration unit and an outer surface of the clamping unit, a silicone pad is installed on a bottom surface of the clamping unit, and at least one slit is formed in the middle of the silicone pad. A toy hairpin wearing device for the toy hairpin comprises a positioning seat and a wearing plate. Because the toy hairpin comprises the clamping unit with the silicone pad, users can gather part of their hairs together and then press the hairs into the slit in the silicone pad by means of the special toy hairpin wearing device; after the toy hairpin wearing device is removed, the slit in the silicone pad form a deformable hair clamping to clamping the hairs, such that the toy hairpin is worn on the hairs. The toy hairpin is convenient and fast to operate, easy to use and suitable for most kids, has good playability and is interesting enough.

However, the applicant finds that although this toy hairpin has good playability and is interesting enough, the silicone pad with the slit needs to be fixed to the bottom surface of the clamping unit, so the toy hairpin has too many machining steps and is high in cost; after repeated use of the silicone pad, the hair clamping capacity of the slit of the silicone pad will be weakened, at this moment, the toy hairpin can no longer be used and has to be discarded, and a new toy hairpin is needed.

SUMMARY

A first objective of the invention is to provide a toy hairpin with a reasonable structure. The toy hairpin is more reasonable in structure, more convenient and faster to wear and remove, easier to make, and lower in cost. The technical solution adopted by the invention is as follows:

A toy hairpin with a reasonable structure comprises a decoration unit and a clamping unit, wherein the clamping unit is disposed at a bottom of the decoration unit, a positioning groove is formed between an outer surface of the decoration unit and an outer surface of the clamping unit, the clamping unit comprises a passive clamping part and an active clamping part, a connecting surface to be connected to the decoration unit and a clamping groove for receiving clamped hairs are disposed on two sides of the passive clamping part respectively, the connecting surface of the passive clamping part is connected to the decoration unit, an outer edge of the clamping groove of the passive clamping part is provided with a clamping step, the active clamping part comprises a base plate and at least two clamping hooks capable of being clamped on the clamping step, and the base plate of the active clamping part is matched with the clamping groove of the passive clamping part to clamp the middle of the hairs. Because all the clamping hooks are clamped on the clamping step when clamped, and the base plate of the active clamping part is matched with the clamping groove of the passive clamping part to clamping the middle of hairs, users can drive the active clamping part and the passive clamping part to move close to each other manually or through a special tool to clamp all the clamping hooks on the clamping step 1020111, such that the toy hairpin is worn on the hairs of users.

Preferably, the clamping hooks are arc-shaped, such that the clamping hooks can be better clamped on the clamping step.

Preferably, the active clamping part comprises two clamping hooks, and two gaps allowing the hairs to enter or come out of the clamping groove are reserved between the two clamping hooks. Hairs enter the clamping groove through one of the two gaps, and leave the clamping groove through the other gap.

Preferably, at least two stop bars are disposed in the clamping groove, and each of the stop bars has an end fixed to a bottom surface of an inner cavity of the clamping groove, as well as an end stretching out of an opening of the clamping groove and abutting against the base plate of the active clamping part. The stop bars are used for pressing against the active clamping part, such that when the clamping hooks are clamped on the clamping step, the active clamping part will not shake, thus keeping the clamping hooks and the clamping step in the clamped state; and a proper distance is maintained between the active clamping part and the passive clamping part, such that the gaps between the two clamping hooks can exit stably, thus protecting hairs against damage.

Preferably, at least one positioning hole used for positioning the base plate is formed in the base plate of the active clamping part. The base plate of the active clamping part can be positioned on a special tool through the positioning hole, such that users can wear the toy hairpin on their hairs.

A second objective of the invention is to provide a toy hairpin wearing device which is used by users to wear a toy hairpin on their hairs. The technical solution adopted by the invention is as follows:

A toy hairpin wearing device for the toy hairpin comprises a positioning plate and a wearing plate, wherein a left end of the wearing plate is hinged to a left end of the positioning plate, a toy hairpin body clamping member capable of clamping the positioning groove of the toy hairpin is disposed at a right end of the positioning plate, and a base plate positioning seat used for positioning the base plate of the active clamping portion is disposed at a right end of an inner side, facing the positioning plate, of the wearing plate. Before use, a user inserts the toy hairpin body clamping member into the positioning groove of the toy hairpin, such that the decoration unit and the passive clamping part of the clamping unit of the toy hairpin are disposed at the right end of the positioning plate. Then, the user places the base plate of the active clamping part of the clamping unit of the toy hairpin on the base plate positioning seat of the wearing plate. Next, the user places part of his/her hairs between the passive clamping part and the active clamping part of the clamping unit, then holds the positioning plate and the wearing plate of the toy hairpin wearing device to force them to rotate toward each other until all the clamping hooks of the active clamping part are clamped on the clamping step of the passive clamping part of the clamping unit. Finally, the user enables the right end of the positioning plate and the right end of the wearing plate to move away from each other, and pulls the toy hairpin body clamping member out of the positioning groove of the toy hairpin, such that the toy hairpin is worn on hairs of the user.

Preferably, the toy hairpin body clamping member is U-shaped.

Preferably, the base plate positioning seat is provided with a base plate positioning groove allowing the base plate of the toy hairpin to be placed therein. The base plate positioning groove is used for positioning and limiting the base plate, such that the base plate is prevented from being separated from the base plate positioning seat.

Preferably, at least one positioning plate to be inserted into the positioning hole of the base plate is disposed on a bottom surface of the base plate positioning groove, the number of the positioning plates is equal to the number of the positioning holes, the positioning plates are in one-to-one correspondence with the positioning holes, and the when the base plate of the toy hairpin is placed in the base plate positioning groove, the positioning plate is inserted into the corresponding positioning hole. The positioning plates are inserted into the corresponding positioning holes to better limit and position the base plate so as to prevent the base plate from shaking, such that the active clamping part can better be clamped with the passive clamping portion when the toy hairpin is worn, and thus, the toy hairpin can be smoothly worn on the hairs of users.

Preferably, the positioning plate and the corresponding positioning hole are identical in shape.

Compared with the prior device, the invention has the following beneficial effects: The structure of the clamping unit is improved, and the passive clamping part and the active clamping part that can be clamped together are used, such that the toy hairpin is more reasonable in structure, more convenient and faster to wear and remove, easier to make, and lower in cost; the toy hairpin wearing device is easier to operate; and the active clamping part can be changed easily when damaged or lost, such that the use cost is effectively reduced.

DETAILED DESCRIPTION

As shown in FIG. 1-FIG. 4, one embodiment of the application provides a toy hairpin 1, comprising a decoration unit 101 and a clamping unit 102, wherein the clamping unit 102 is disposed at the bottom of the decoration unit 101, a positioning groove 103 is formed between an outer surface of the decoration unit 101 and an outer surface of the clamping unit 102, the clamping unit 102 comprises a passive clamping part 10201 and an active clamping part 10202, a connecting surface to be connected to the decoration unit 101 and a clamping groove 102011 for receiving clamped hairs are disposed on two sides of the passive clamping part 10201 respectively, the connecting surface of the passive clamping part 10201 is connected to the decoration unit 101, an outer edge of the clamping groove 102011 of the passive clamping part 10201 is provided with a clamping step 1020111, the active clamping part 10202 comprises a base plate 102021 and at least two clamping hooks 102022 capable of being clamped on the clamping step 1020111, all the clamping hooks 102022 are clamped on the clamping step 1020111 when clamped, and the base plate 102021 of the active clamping part 10202 is matched with the clamping groove 102011 of the passive clamping part 10201 to clamping the middle of hairs. Because all the clamping hooks 102022 are clamped on the clamping step 1020111 when clamped, and the base plate 102021 of the active clamping part 10202 is matched with the clamping groove 102011 of the passive clamping part 10201 to clamping the middle of hairs, users can drive the active clamping part 10202 and the passive clamping part 10201 to move close to each other manually or through a special tool to clamp all the clamping hooks 102022 on the clamping step 1020111, such that the toy hairpin 1 is worn on the hairs of users.

Figure 1:
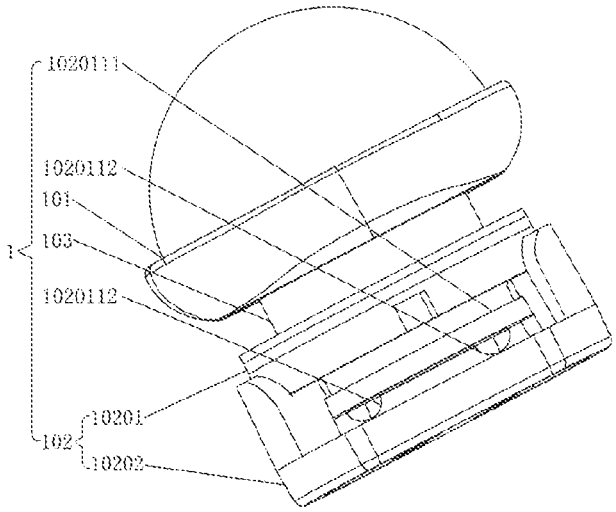
FIG. 1 is a structural diagram of a toy hairpin according to one embodiment of the invention.
Figure 2:
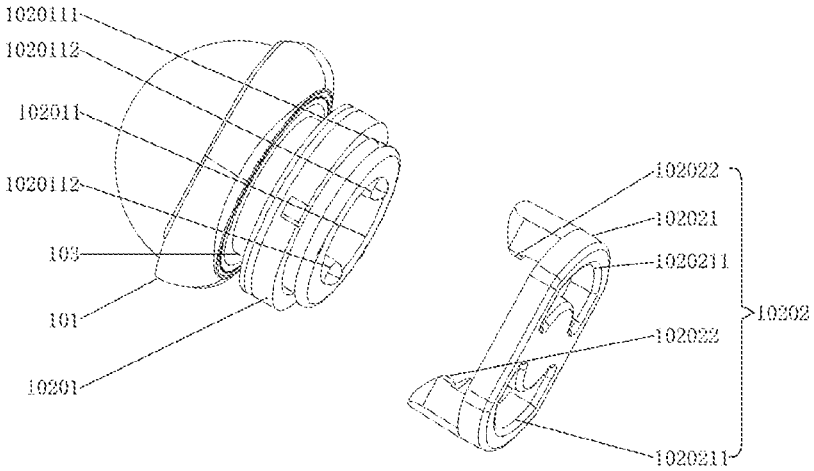
FIG. 2 is an exploded view of the toy hairpin according to the embodiment shown in FIG. 1.
Figure 3:
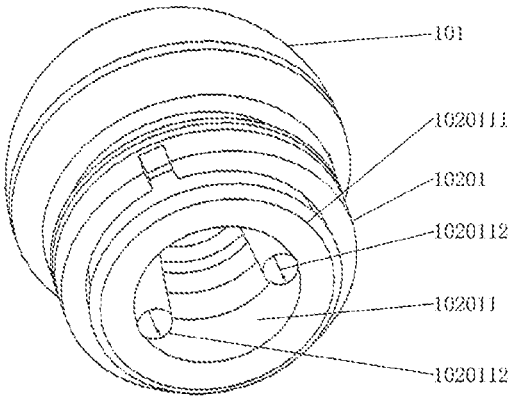
FIG. 3 is an enlarged view of a decoration unit and a passive clamping part of a clamping unit of the toy hairpin according to the embodiment shown in FIG. 1.
Figure 4:
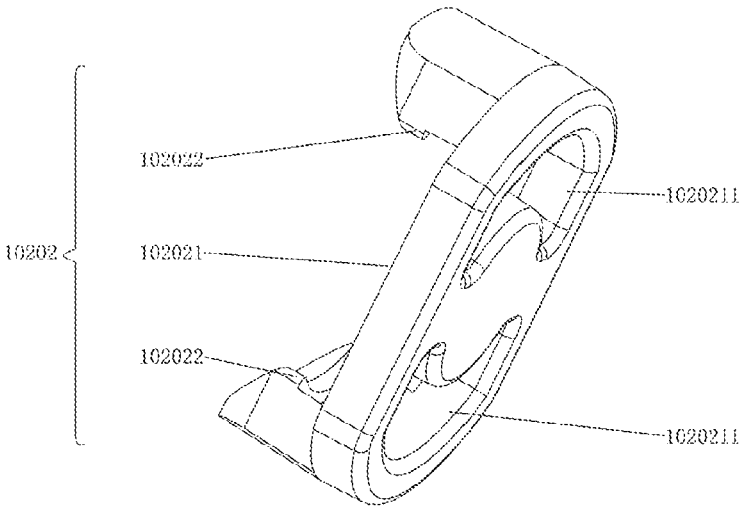
FIG. 4 is an enlarged view of an active clamping part of the toy hairpin according to the Embodiment shown in FIG. 1.

As shown in FIG. 1, in one optional embodiment, the decoration unit 101 and the passive clamping part 10201 of the clamping unit 102 are made integrally. In other optionally embodiments, the decoration unit 101 and the passive clamping part 10201 of the clamping unit 102 may be made separately and are then connected; or, the decoration unit 101 and the passive clamping part 10201 of the clamping unit 102 are integrally made partially, and part of components of the decoration unit 101 and the passive clamping part 10201 of the clamping unit 102 are made separately and are then assembled together.

As shown in FIG. 1, in one optional embodiment, the clamping hooks 102022 are arc-shaped, such that the clamping hooks 102022 can be better clamped on the clamping step 1020111.

As shown in FIG. 1, in one optional embodiment, the active clamping part 10202 comprises two clamping hooks 102022, and two gaps allowing hairs to enter or come out of the clamping groove 102011 are reserved between the two clamping hooks 102022. Hairs enter the clamping groove 102011 through one of the two gaps, and leave the clamping groove 102011 through the other gap.

As shown in FIG. 1, in one optional embodiment, two stop bars 1020112 are disposed in the clamping groove 102011, and each stop bar 1020112 has an end fixed to a bottom surface of an inner cavity of the clamping groove 102011, as well as an end stretching out an opening of the clamping groove 102011 and abutting against the base plate 102021 of the active clamping part. The stop bars 1020112 are used for pressing against the active clamping part 10202, such that when the clamping hooks 102022 are clamped on the clamping step 1020111, the active clamping part 10202 will not shake, thus keeping the clamping hooks 102022 and the clamping step 1020111 in the clamped state; and a proper distance is maintained between the active clamping part 10202 and the passive clamping part 10201, such that the gaps between the two clamping hooks 102022 can exit stably, thus protecting hairs against damage.

As shown in FIG. 1, in an optional embodiment, the base plate 102021 of the active clamping part 10202 is formed with two positioning holes 1020211 used for positioning the base plate 102021. The base plate 102021 of the active clamping part 10202 can be positioned on a special tool through the positioning holes 1020211, such that users can wear the toy hairpin 1 on their hairs.

Figure 5:
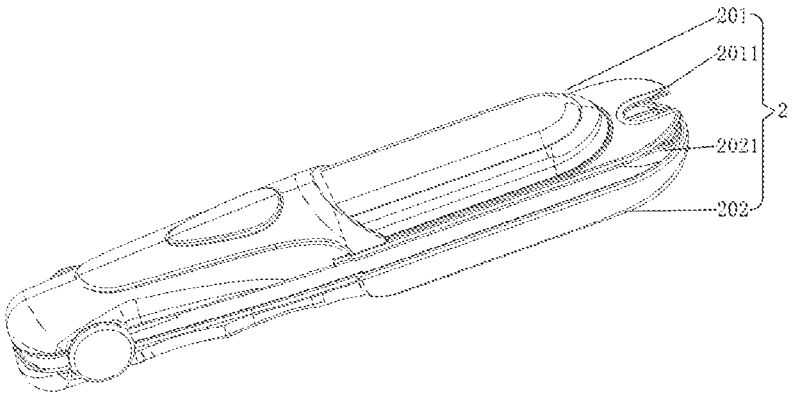
FIG. 5 is a structural view of a toy hairpin wearing device according to one embodiment of the invention.
Figure 6:
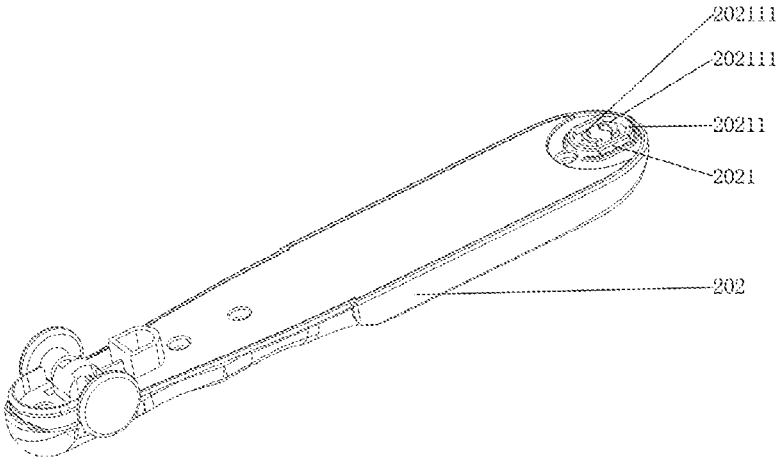
FIG. 6 is an enlarged view of a wearing plate of the toy hairpin wearing device according to the Embodiment shown in FIG. 5.
Figure 7:
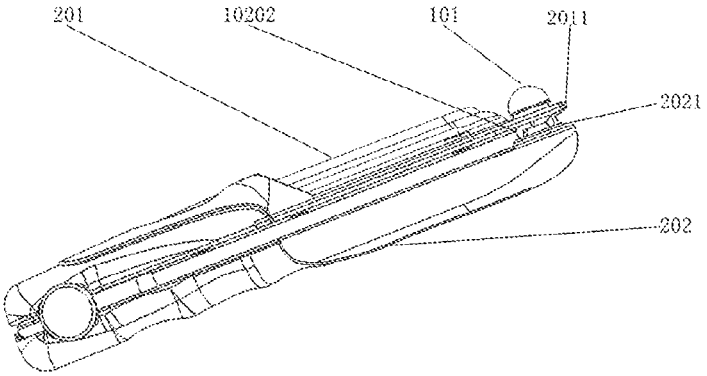
FIG. 7 is a reference diagram of the toy hairpin wearing device in use according to one embodiment of the invention.

As shown in FIG. 5 and FIG. 6, in one optional embodiment, a toy hairpin wearing device 2 for the toy hairpin 1 comprises a positioning plate 201 and a wearing plate 202, wherein a left end of the wearing plate 202 is hinged to a left end of the positioning plate 201, a toy hairpin body clamping member 2011 capable of clamping the positioning groove 103 of the toy hairpin 1 is disposed at a right end of the positioning plate 201, and a base plate positioning seat 2021 used for positioning the base plate 102021 of the active clamping part 10202 is disposed at a right end of an inner side, facing the positioning plate 201, of the wearing plate 202.

As shown in FIG. 5, in one optional embodiment, the toy hairpin body clamping member 2011 is U-shaped.

As shown in FIG. 6, in an optional embodiment, the base plate positioning seat 2021 is provided with a base plate positioning groove 20211 allowing the base plate 102021 of the toy hairpin 1 to be placed therein.

As shown in FIG. 6, in one optional embodiment, two positioning plates 202111 to be inserted into the positioning holes 1020212 of the base plate 102021 are disposed on a bottom surface of the base plate positioning groove 202111; the number of the positioning plates 202111 is equal to the number of the positioning holes 1020212, and the positioning plates 202111 are in one-to-one correspondence with the positioning holes 1020212; and when the base plate 102021 of the toy hairpin 1 is placed in the base plate positioning groove 20211, the positioning plates 202111 are inserted into the corresponding positioning holes 1020212.

As shown in FIG. 6, in one optional embodiment, the positioning plates 202111 and the corresponding positioning holes 1020212 are identical in shape and are both arc-shaped.

As shown in FIG. 1-FIG. 7, the working process is as follows:

During use, a user inserts the toy hairpin body clamping member 2011 into the positioning groove 103 of the toy hairpin 1, such that the decoration unit 101 and the passive clamping part 10201 of the clamping unit 102 of the toy hairpin 1 are disposed at the right end of the positioning plate 201.

Then, the user places the base plate 102021 of the active clamping part 10202 of the clamping unit 102 of the toy hairpin 1 on the base plate positioning seat 2021 of the wearing plate 202.

Next, the user places part of his/her hairs between the passive clamping part 10201 and the active clamping part 10202 of the clamping unit 102, then holds the positioning plate 201 and the wearing plate 202 of the toy hairpin wearing device 2 to force them to rotate toward each other until all the clamping hooks 102022 of the active clamping part 10202 are clamped on the clamping step 1020111 of the passive clamping part 10201 of the clamping unit 102.

Finally, the user enables the right end of the positioning plate 201 and the right end of the wearing plate 202 to move away from each other, and pulls the toy hairpin body clamping member 2011 out of the positioning groove 103 of the toy hairpin 1, such that the toy hairpin 1 is worn on hairs of the user.

Compared with the previous utility model patent (CN214677955U) of the applicant, such a structural design replaces the silicone pad with the active clamping part 10202, such that users can place part of their hairs between the positioning plate 201 and the wearing plate 202 more conveniently and rapidly, so as to wear the toy hairpin on their hairs quickly. When the toy hairpin needs to be removed from the hairs, the users just need to hold and then pull the toy hairpin, and then the toy hairpin can be removed from their hairs easily, which can also be completed by a kid independently; and the hairs of the users are protected against damage caused by an excessively large clamping force of the toy hairpin, so the safety performance is high. The toy hairpin has a more reasonable structure, thus being easier to make, lower in cost, and convenient and fast to wear and remove; and the active clamping part 10202 can be easily replaced with a new active clamping part 10202 when damaged or lost.

In addition, it should be noted that the names of parts in the specific embodiments described in this specification may be different, and all equivalent or simple modifications made according to the structures, features and principles of the invention should fall within the protection scope of the invention. Various amendments, supplements or similar substitutions made to the specific embodiments described in this specification by those skilled in the art without departing from the structures of the invention or exceeding the scope defined by the claims should fall within the protection scope of the invention.

What is claimed is:

1. A toy hairpin system, comprising a decoration unit and a clamping unit, the clamping unit being disposed at a bottom of the decoration unit, a positioning groove being formed between an outer surface of the decoration unit and an outer surface of the clamping unit, wherein the clamping unit comprises a passive clamping part and an active clamping part, a connecting surface to be connected to the decoration unit and a clamping groove for receiving clamped hairs are disposed on two sides of the passive clamping part respectively, the connecting surface of the passive clamping part is connected to the decoration unit, an outer edge of the clamping groove of the passive clamping part is provided with a clamping step, the active clamping part comprises a base plate and at least two clamping hooks capable of being clamped on the clamping step, and the base plate of the active clamping part is matched with the clamping groove of the passive clamping part to clamp a middle of the hairs, wherein at least one positioning hole used for positioning the base plate is formed in the base plate of the active clamping part; and A toy hairpin wearing device for the toy hairpin comprising a positioning plate and a wearing plate, wherein a left end of the wearing plate is hinged to a left end of the positioning plate, a toy hairpin body clamping member capable of clamping the positioning groove of the toy hairpin is disposed at a right end of the positioning plate, and a base plate positioning seat used for positioning the base plate of the active clamping portion is disposed at a right end of an inner side, facing the positioning plate, of the wearing plate.

2. The toy hairpin system according to claim 1, wherein the at least two clamping hooks are arc-shaped.

3. The toy hairpin system according to claim 1, wherein the active clamping part comprises the at least two clamping hooks, and two gaps allowing the hairs to enter or come out of the clamping groove are reserved between the at least two clamping hooks.

4. The toy hairpin system according to claim 1, wherein at least two stop bars are disposed in the clamping groove, and each of the stop bars has an end fixed to a bottom surface of an inner cavity of the clamping groove, as well as an end stretching out of an opening of the clamping groove and abutting against the base plate of the active clamping part.

5. The toy hairpin system according to claim 1, wherein the toy hairpin body clamping member is U-shaped.

6. The toy hairpin system according to claim 1, wherein the base plate positioning seat is provided with a base plate positioning groove allowing the base plate of the toy hairpin to be placed therein.

7. The toy hairpin system according to claim 6, wherein at least one positioning plate to be inserted into the positioning hole of the base plate is disposed on a bottom surface of the base plate positioning groove, a number of the positioning plates is equal to a number of the positioning holes, the positioning plates are in one-to-one correspondence with the positioning holes, and when the base plate of the toy hairpin is placed in the base plate positioning groove, the at least one positioning plate is inserted into the corresponding positioning hole.

8. The toy hairpin system according to claim 7, wherein the at least one positioning plate and the corresponding positioning hole are identical in shape.

* * * * *